US007823928B2

(12) United States Patent
Reinhart et al.

(10) Patent No.: US 7,823,928 B2
(45) Date of Patent: Nov. 2, 2010

(54) VALUABLE DOCUMENT AND METHOD FOR PRODUCING A VALUABLE DOCUMENT

(75) Inventors: Werner Reinhart, Zirndorf (DE); Norbert Lutz, Rückersdorf (DE)

(73) Assignee: Leonhard Kurz Stiftung & Co. KG, Furth (DE)

( * ) Notice: Subject to any disclaimer, the term of this patent is extended or adjusted under 35 U.S.C. 154(b) by 732 days.

(21) Appl. No.: 11/575,184

(22) PCT Filed: Sep. 15, 2005

(86) PCT No.: PCT/DE2005/001621

§ 371 (c)(1),
(2), (4) Date: May 23, 2007

(87) PCT Pub. No.: WO2006/029609

PCT Pub. Date: Mar. 23, 2006

(65) Prior Publication Data

US 2007/0224383 A1 Sep. 27, 2007

(30) Foreign Application Priority Data

Sep. 16, 2004 (DE) ..... 10 2004 044 831

(51) Int. Cl.

| | |
|---|---|
| ***B42D 15/00*** | (2006.01) |
| ***B42D 15/10*** | (2006.01) |
| ***B65D 65/28*** | (2006.01) |
| ***G09F 3/00*** | (2006.01) |

(52) U.S. Cl. ..... 283/105; 283/94; 283/72; 428/43; 428/916

(58) Field of Classification Search ..... 283/67, 283/72, 81, 94, 105; 428/43, 916; 156/250
See application file for complete search history.

(56) References Cited

U.S. PATENT DOCUMENTS

| | | | | |
|---|---|---|---|---|
| 5,393,099 | A | 2/1995 | D'Amato | |
| 5,413,839 | A | 5/1995 | Chatwin et al. | |
| 5,454,598 | A | 10/1995 | Wicker | |
| 5,762,378 | A * | 6/1998 | Phillips | 283/72 |
| 5,801,857 | A * | 9/1998 | Heckenkamp et al. | 359/2 |
| 6,508,489 | B2 * | 1/2003 | Herrmann et al. | 283/57 |
| 6,630,055 | B1 | 10/2003 | Goguelin et al. | |
| 6,786,513 | B1 * | 9/2004 | Cobben et al. | 283/72 |
| 2006/0119096 | A1 | 6/2006 | Reinhart | |

FOREIGN PATENT DOCUMENTS

| | | |
|---|---|---|
| DE | 10305288 | 8/2004 |
| EP | 0723501 | 4/1995 |
| EP | 0748286 | 9/2003 |
| EP | 1398174 | 3/2004 |
| WO | WO9718092 | 5/1997 |
| WO | WO2004028825 | 4/2004 |
| WO | WO2004/069560 A2 | 8/2004 |

* cited by examiner

*Primary Examiner*—Dana Ross
*Assistant Examiner*—Kyle Grabowski
(74) *Attorney, Agent, or Firm*—Hoffmann & Baron, LLP

(57) ABSTRACT

The invention concerns a value-bearing document and a process for the production of a value-bearing document. The value-bearing document comprises a carrier of a paper material and a laminating film which is applied to the carrier and which has a carrier film and a decorative layer arrangement including one or more security features and/or one or more components with electrical functionalities. The laminating film is provided with predetermined breaking locations the reducing the strength of the laminating film.

32 Claims, 14 Drawing Sheets

VALUABLE DOCUMENT AND METHOD FOR PRODUCING A VALUABLE DOCUMENT

This application claims priority based on an International Application tiled under the Patent Cooperation Treaty, PCT/DE2005/001621, filed on Sep. 15, 2005 and German Application No. 102004044831.0-26, filed on Sep. 16, 2004.

BACKGROUND OF THE INVENTION

The invention concerns a value-bearing document with a carrier comprising a paper material and a laminating film which is applied to the carrier and which has a carrier film and a decorative layer having one or more optical security features, as well as a process for the production of such a value-bearing document.

In order to enhance the forgery-proof nature of value-bearing documents it is known for example to apply to bank notes or visas a hot stamping film with an optical security feature. When hot stamping films are applied to value-bearing documents, it is only the transfer layer of the hot stamping film but not the carrier film that is transferred. As the layer array of the transfer layer is typically between 6 and 12 μm in thickness the application operation can be effected at comparatively low temperatures and pressures. That means that only low thermal stresses occur during the hot stamping operation and upon cooling after the stamping operation has been implemented so that at best minimum deformation of the composite comprising the value-bearing document and the layer array occurs. The thermal stresses of the composite comprising the value-bearing document and the layer array of the transfer layer can be further minimized by suitably implementing the properties of the transferred layers.

The transfer layer is typically made up of lacquer, adhesive and metallic layers which are of entirely different physical properties (thermal conductivity, thermal capacity, thermal expansion and so forth) from the carrier.

The small thickness of the transferred layer array and the low inherent stability thereof makes it almost impossible to subsequently detach the applied transfer layer of the hot stamping film from the value-bearing document, without entailing destruction. That means that the production of forged documents by removal of the transfer layer of the hot stamping film from the original document and applying the detached layer array to forged documents is extremely difficult.

It is further known for optical security features to be applied to bank notes using laminating films. In contrast to hot stamping films, in the film body which is transferred onto the bank note laminating films have a carrier film which for example comprises a polyester film of a thickness of between 19 μm and 50 μm and imparts a certain level of inherent mechanical stability to the laminating film. Thus EP 0 723 501 B1 discloses forming an opening in the paper carrier of a bank note and closing that opening again by means of a cover film which is at least region-wise transparent. In that case the cover film comprises a laminating film which includes a transparent carrier film and a decorative layer which adheres firmly to the transparent carrier film. In that arrangement the decorative layer has a lacquer layer which is transparent at least region-wise at least in the region of the opening. In that case diffraction structures which have an optical-diffraction effect and which afford an optical security feature are shaped into the lacquer layer.

Applying laminating films to value-bearing documents makes it possible for a plurality of security features to be transferred during one application operation and for additional functionalities to be transferred onto documents by means of stamping processes. Advantages are afforded in particular in the production of value-bearing documents with windows, but also in the production of value-bearing documents with electrical functionalities, for example documents with integrated circuits, antennas and displays. Laminating films are more suitable for that use than hot stamping films as, by virtue of the mechanical stability of the carrier film, on the one hand they ensure better processability in the application operation while on the other hand they ensure stabilization of the layer array on the document after application. The carrier film of the laminating film also represents protection from environmental influences and from attempts at manipulation.

However substantially higher temperatures and pressures are required when applying laminating films to paper substrates, than for applying hot stamping films. The differing thermal coefficients of expansion of the film and the substrate as well as the heating thereof to differing extents mean that, when cooling occurs, high thermal stresses are induced, which can result in distortion of the film-substrate composite, whereby flat positioning of the value-bearing documents may no longer be possible and further handling and processability, for example when stacking sheets, can be made difficult.

It is further known from EP 0 748 286 B1 for a perforated pattern to be introduced by means of a laser beam into the carrier of a check, a bank note or a credit card which is provided with an individualized pattern printed thereon, for example a serial number. The printed individualized pattern can be perceived with the human eye just like the individualized pattern formed from perforations. The perforated pattern and the printed pattern have the same characters so that forgeries can be easily detected. In that case forgery of the value-bearing document is particularly difficult as it is almost impossible for the resulting perforations to be filled up.

SUMMARY OF INVENTION

Now the object of the invention is to provide an improved value-bearing document with an applied laminating film and a production process for such a value-bearing document.

That object is attained by a value-bearing document having a carrier comprising a paper material and a laminating film which is applied to the carrier and which has a carrier film and a decorative layer including one or more security features and/or one or more components with electrical functionalities, in which the laminating film is provided with predetermined breaking locations for reducing the strength of the laminating film.

That object is further attained by a process for the production of a value-bearing document wherein a laminating film is applied to a carrier, comprising paper material, of the value-bearing document, which laminating film has a carrier film and a decorative layer including one or more security features and/or one or more components with electrical functionalities, and wherein the laminating film is provided with predetermined breaking locations for reducing the strength of the laminating film.

In accordance with the invention it is thus proposed that a laminating film applied to the carrier of a value-bearing document is provided with predetermined breaking locations. By virtue thereof the thermal stresses which occur upon application of the laminating film to the carrier are absorbed and distortion of the film-paper substrate is prevented. Furthermore attempts at manipulation face increased difficulty. The inherent mechanical stability of the laminating film, which is increased in relation to hot stamping films by virtue of the mechanical stability of the carrier film used, is weakened by the predetermined breaking locations so that subsequent, destruction-free detachment of the applied laminating film from value-bearing documents is almost impossible. Thus it is scarcely any longer possible to produce forged documents by the removal of the laminating film from the original document and application of the detached laminating film to forged documents. Thus the invention makes it possible to combine the advantages of a hot stamping film in relation to application properties and degree of safeguard against manipulation, with the properties of a laminating film in relation to implementable security features, and thus improve both the production process and also the forgery-proof nature of value-bearing documents.

In this case security features contained in the decorative layer are preferably optically discernible security features. Those security features however may also be machine-readable security features, for example magnetic or conductive security features which are afforded by magnetic or electrically conductive layers of the decorative layer arrangement. In addition those security features can also be security features which can be triggered by means of radio or for example security features formed by fluorescent elements. Components with electrical functionality are preferably electrical or electronic members, for example antennas, coils, capacitances as well as active members, for example transistors.

Advantageous developments of the invention are set forth in the appendant claims.

In accordance with a preferred embodiment of the invention the strength and mechanical stability of the laminating film in the region of the predetermined breaking locations is reduced by perforation or partial severing of one or more layers of the laminating film. In that case the predetermined breaking locations are preferably produced by means of laser radiation. For that purpose, one or more layers of the laminating film are at least partially removed in the region of the predetermined breaking locations by melting, vaporization or disintegration by means of the laser. That affords the advantage that on the one hand it is possible to produce predetermined breaking locations of very small diameters and on the other hand the working operation can be effected in a contactless and wear-free procedure.

Further advantages are afforded by virtue of the fact that processing in accurate register relationship can be implemented by suitable control of the laser beam, for example with reference to register marks on the laminating film. Predetermined breaking locations are thus produced in accurate register relationship with pattern regions of security elements of the laminating film and are thus integrated into the design of security features of the laminating films.

Thus it is possible for example for predetermined breaking locations to be produced in accurate register relationship in relation to demetallized regions present in the laminating film. It is thus possible to integrate the predetermined breaking locations into the demetallization design or to produce regions demetallized by the predetermined breaking locations, if the laser provides that the metal coating of the laminating film is also partially removed.

By means of the laser, the laminating film can further be provided in the region of the predetermined breaking locations with micro-perforations, the diameters of which are below the resolution capability of the human eye (diameters preferably less than 50 μm) so that the predetermined breaking locations are not perceptible to the viewer at least when considered in incident light.

It is further possible for an optically discernible perforation pattern, for example in the form of a microscript, to be produced in the laminating film in a quality which is not possible with conventional processes, by virtue of a very small diameter for the laser beam which however is in the region of the resolution capability of the human eye. Such a perforation pattern is particularly readily discernible if metallic layers of the laminating film are severed therethrough by the laser beam, in which case such a perforation pattern can also be integrated in the demetallization design of a security element.

In addition it is possible for the predetermined breaking locations to be introduced into the laminating film by means of mechanical processes such as shearing cutting or forming holes. One or more layers of the laminating film are severed or cut into by mechanical processes of that kind, whereby the strength of the laminating film is reduced in the region of the predetermined breaking locations. It is thus possible for the tools to be so adjusted that the carrier layer of the laminating film is cut into, but is not stamped through.

In accordance with a further preferred embodiment of the invention the strength of the laminating film is reduced in the region of the predetermined breaking locations by a partial variation in physical properties of one or more layers of the laminating film. That can be implemented for example by partial irradiation of the laminating film with electromagnetic radiation which causes a chemical change to be induced in one or more layers of the laminating film.

Preferably, the strength of the laminating film is reduced in the region of the predetermined breaking locations by the carrier film being severed in the region of the predetermined breaking locations. Thus for example the carrier film comprises a laser radiation-absorbent material which is partially removed in the region of the predetermined breaking locations by melting or vaporization. It is further possible for the carrier film to be provided in the region of the predetermined breaking locations with blind holes which do not completely sever the carrier film therethrough. That provides on the one hand that the strength of the laminating film is considerably reduced in the region of the blind holes. On the other hand the carrier film can still act in the region of the predetermined breaking locations as a protective layer for the decorative layer disposed therebeneath. Furthermore, with that procedure, it is possible for the mechanical behavior of the laminating film to be influenced in a specifically targeted fashion by way of the depth of the blind holes.

Preferably in that case the blind holes are arranged on the side of the carrier film which is towards the carrier consisting of its paper material so that the surface of the carrier film, that is towards the viewer, forms a flat surface. If the decorative layer is of a suitable configuration—the blind holes thus remain optically concealed and the abrasion resistance and resistance to weathering of the laminating film are increased in comparison with the above-indicated possibility.

Further advantageous effects can be achieved by the layer of the laminating film, that is towards the paper carrier, being provided with perforations in the region of the predetermined breaking location. If, prior to application of the laminating film to the carrier consisting of a paper material, the laminating film is provided with blind holes from the side towards the carrier in the region of the predetermined breaking locations, then upon application of the laminating film the paper fibers of the paper carrier become interlinked in those blind holes whereby the adhesion between the paper carrier and the laminating film is improved.

In accordance with a preferred embodiment of the invention the arrangement and dimensions of the predetermined breaking locations are so selected that the mechanical behavior of the laminating film is adapted to the mechanical behavior of the paper carrier by virtue of the laminating film being weakened by the predetermined breaking locations. The strength of the film can be so adjusted by a suitable configuration for the cross-section, the dimensions, the profile, the arrangement and the spacing of the predetermined breaking locations, that on the one hand their processability is maintained while on the other hand the occurrence of stresses between the laminating film and the paper carrier due to thermal or mechanical influences can be avoided. It is thus advantageous for example that the weakening effect on the laminating film by the predetermined breaking locations means that the coefficient of expansion of the laminating film is set to be greater than or equal to the coefficient of expansion of the paper carrier so that no distortions occur between regions of the value-bearing document to which the laminating film is applied and those regions to which the laminating film is not applied. Furthermore the strength of the film is preferably so adjusted that it cannot be detached prior to application without being damaged, but processability thereof is retained.

It has proven to be advantageous if the predetermined breaking locations are arranged on lines in the expansion direction or transversely with respect to the expansion direction in order to be able to reduce the stresses in the laminating film, which occur upon cooling after the application process. If the laminating film is in the form of a strip then the predetermined breaking locations are preferably to be arranged on one or more lines in the longitudinal direction of the strip in order reliably to prevent the occurrence of distortion.

The operation of producing the predetermined breaking locations is preferably effected prior to application of the laminating film to the value-bearing document, that is to say during film production. Alternatively the operation of producing the predetermined breaking locations can also be effected in the application machine immediately prior to application or after film application to the document.

BRIEF DESCRIPTION OF THE DRAWINGS

The invention is described by way of example hereinafter by means of a number of embodiments with reference to the accompanying drawings in which.

DETAILED DESCRIPTION OF THE INVENTION

Figure 1:
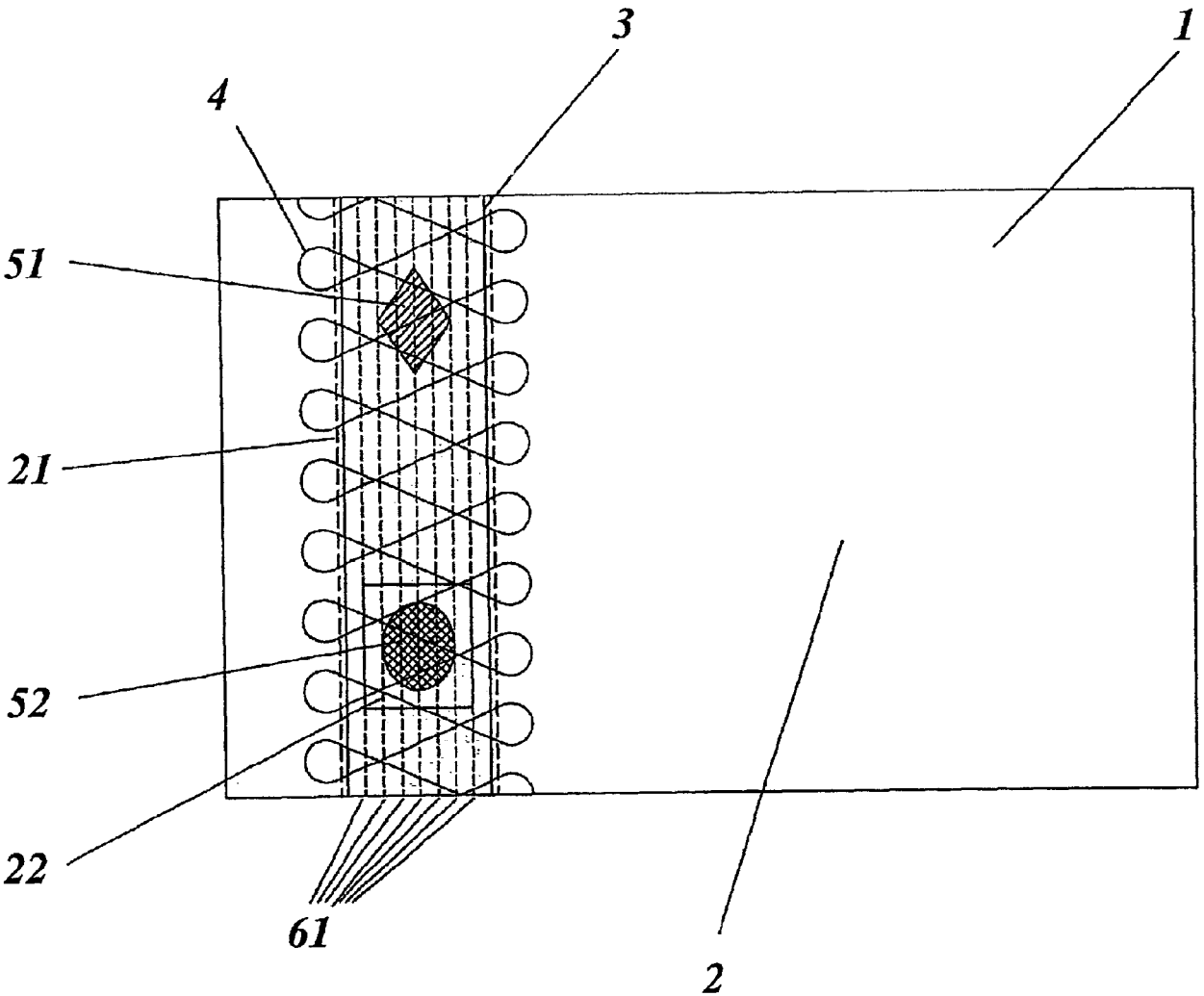
FIG. 1 shows a diagrammatic view of a value-bearing document according to the invention.

FIG. 1 shows a value-bearing document 1 which is for example a bank note, a visa, an identification document or a software certificate. The value-bearing document 1 comprises a carrier 2 to which a strip-shaped laminating film is applied as shown in FIG. 1 and then overprinted with a pattern 4.

The carrier 2 comprises a paper material and is of a thickness of about 100 μm. In this respect the carrier 2 can be provided in known manner with security elements, for example a watermark or a security print thereon. A window-like opening 22 is further formed in the carrier 2, for example by stamping, which is closed by the laminating film 3.

The laminating film 3 has two security features 51 and 52 of which the security feature 52 is arranged in the region of the window-like opening 22. Preferably in this case the laminating film 3 is applied into a depression in the carrier 2 so that the value-bearing document 1 is not increased in its thickness in the region in which the laminating film 3 is applied. That ensures that stackabilty and further processability of the value-bearing document 1 are not adversely affected by application of the laminating film 3. In this case the depression 21 can be produced in the carrier 2 in the paper production procedure but it is also possible for that depression to be produced by a stamping operation or by the pressure exerted on the carrier 2 upon application of the laminating film 3 and the resulting partial compacting of the paper material.

As shown in FIG. 1 the laminating film 3 is provided with predetermined breaking locations which are arranged on lines 61 and which are formed in the laminating film 3 prior to application thereof to the carrier 2 by means of mechanical processes such as shearing cutting or holing, preferably however by means of laser radiation.

Figure 2:
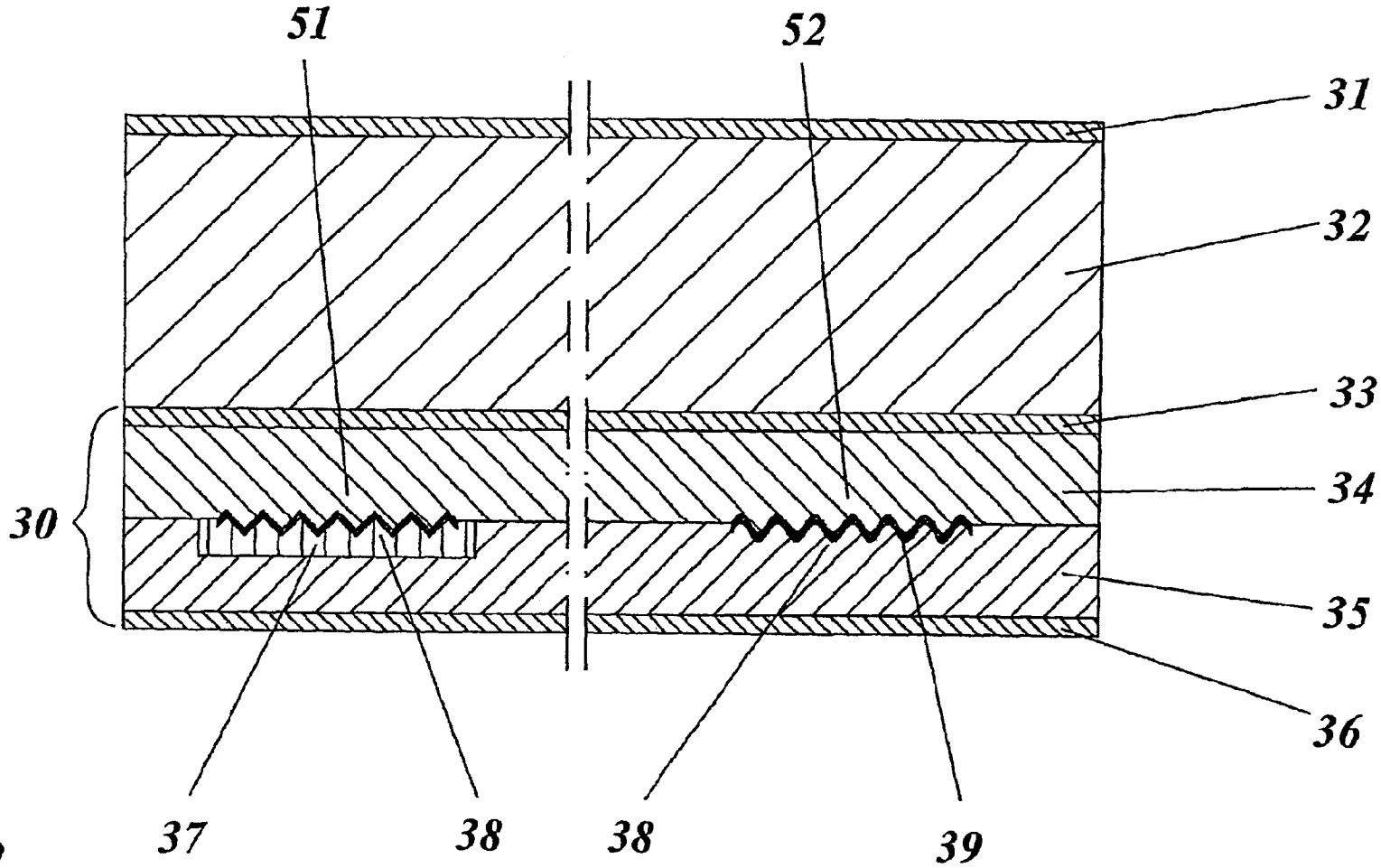
FIG. 2 shows a cross-sectional view of two regions of a laminating film which can be used for the value-bearing document of FIG. 1, FIGS. 3*a* and 3*b* show cross-sectional views of two different regions of the value-bearing document shown in FIG. 1, FIGS. 4*a* and 4*b* show views of a part of a laminating film which can be used for the value-bearing document of FIG. 1 and which is provided with predetermined breaking locations.

FIG. 2 shows the structure of the laminating film 3 in the region of the security features 51 and 52.

The laminating film 3 comprises a layer sequence of bonding layer 31, a carrier film 32 and a decorative layer arrangement 30 with a bonding layer 33, two lacquer layers 34 and 35 and a bonding layer 36.

The bonding layers 31, 33 and 36 are between 0.2 and 2 μm in thickness, preferably between 0.5 and 1.2 μm. It is possible to dispense with the bonding layer 31 if subsequent overprinting of the laminating film after application is dispensed with. The bonding layer 36 is preferably a thermally activatable adhesive layer which ensures adhesion of the laminating film 3 on the paper carrier 2 upon application. The bonding layer 36 however can also comprise a UV-crosslinkable adhesive layer.

The carrier film 32 is a plastic film, preferably a polyester or polycarbonate film, of a thickness of between 12 μm and 50 μm, further preferably between 25 μm and 50 μm. The carrier film 32 imparts to the laminating film 3 its functionally necessary inherent mechanical stability which is required for example for closing the window opening 22 in such a way that it can bear mechanical loads.

The lacquer layer 34 is a replication lacquer layer of a thickness of between 0.8 and 2 μm in which a diffractive structure 38 is formed in region-wise manner. Thus the lacquer layer 34 comprises for example a thermally deformable base lacquer layer into which different diffractive structures are shaped by means of a heated stamping punch in the regions of the security features 51 and 52, the diffractive structures generating for example different holographic representations or different Kinegrams®. In the region of the security feature 52 the diffractive structure 38 is provided with a partial metallic coating 39 so that this provides a reflective, diffractive security feature. The metallization here comprises for example aluminum, chromium, gold or silver applied in a vacuum. Instead of a metallic coating it is also possible to apply to the lacquer layer 34 an HRI or LRI layer (HRI=high refraction index; LRI=low refraction index) comprising a suitable dielectric, for example $TiO_2$ or ZnS, as a reflection-increasing layer.

The lacquer layer 35 is then applied, as a protective lacquer layer. Provided in the region of the security feature 51 in region-wise fashion between the replication lacquer layer and the protective lacquer layer is a further colored lacquer layer 37 which is applied in pattern form and which acts as a further decorative element. It would also be possible to dispense with the lacquer layer 35.

It is also possible here for a UV-crosslinkable replication lacquer layer to be used as the lacquer layer 34 and for the diffraction structures 38 to be shaped in the lacquer layer 34 by means of a UV replication process. In addition it is also possible to provide a transparent diffractive security feature in the region of the opening 22. In that case, the opaque metallic coating 39 is omitted, the metallic coating is rather either transparent or the metallic coating 39 is entirely omitted and a material used for the lacquer layer 35 is one whose refractive index is markedly different from that of the lacquer layer 34.

Figure 3A:
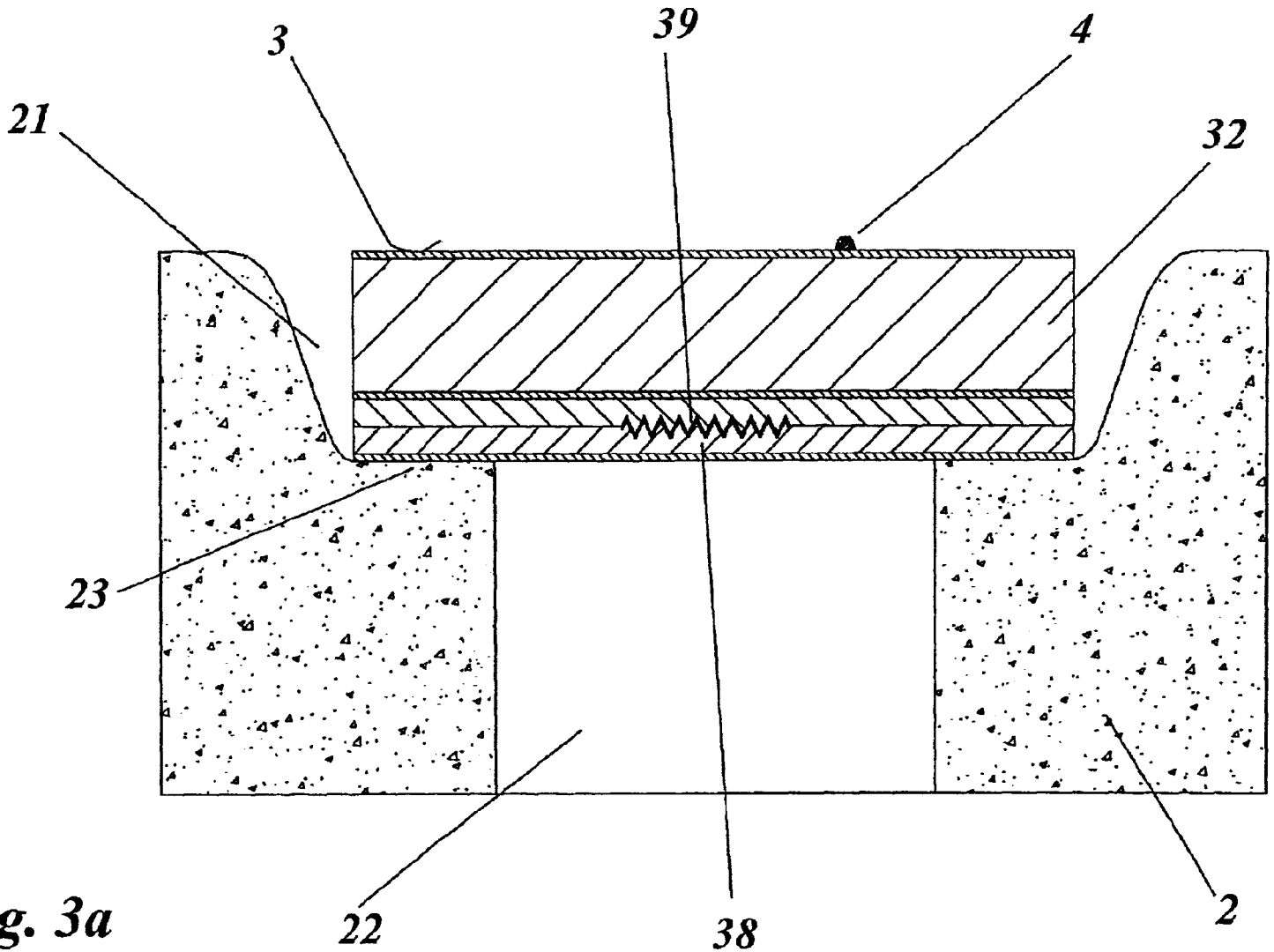

FIG. 3*a* now shows a sectional view, which is not true to scale, of the value-bearing document 1 in the region of the window-like opening 22 with the carrier 2, the depression 21 and the laminating film 3 which is overprinted with the pattern 4. The carrier film 22, the bonding layers 31, 33 and 36 as well as the lacquer layers 34 and 35 are transparent so that the security feature generated by the diffractive structure 38 which is provided with the metal layer 39 is framed by a transparent window. As can be seen from FIG. 3*a* the opening 22 is closed by the laminating film 3 which projects beyond it on all sides, wherein the laminating film 3 is glued to the carrier 2 in an adhesion region 23 of sufficiently large dimension.

It is further possible, instead of or in addition to the above-described diffractive security elements, to integrate into the decorative layer 30 of the laminating film 3 thin film layer systems which produce a viewing angle-dependent color shift by means of interference or (cholesteric) liquid crystal layers. In addition it is also possible, instead or in addition to such security elements, for electrical functionalities such as for example integrated circuits, antennas and displays to be integrated into the decorative layer 30 of the laminating film 3.

Figure 3B:
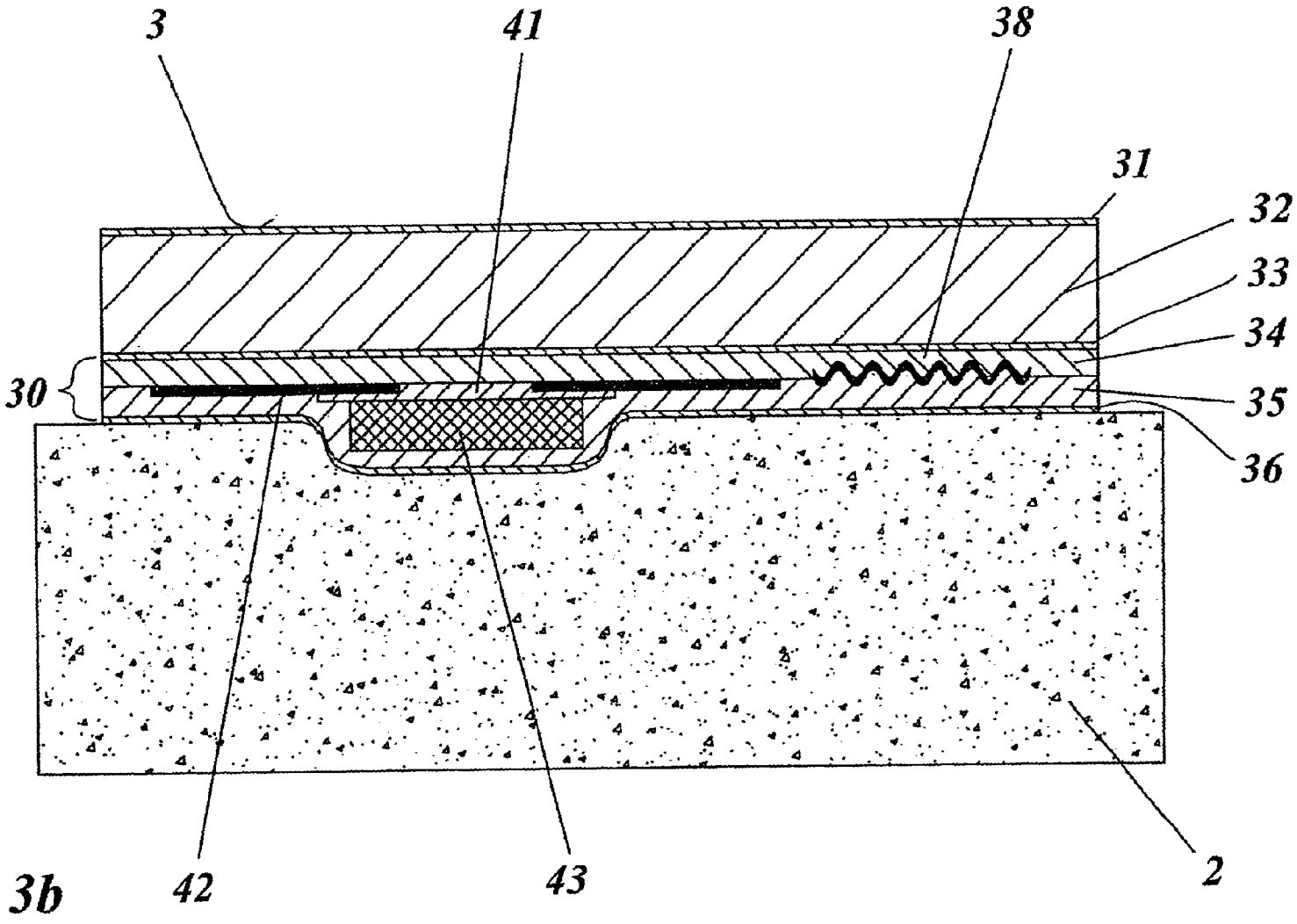

Thus for example FIG. 3*b* shows a region of the value-bearing document 1 in which, besides an optically discernible, diffractive security feature, an RF identification circuit (RF=radio frequency) is integrated into the decorative layer 30. In that region the laminating film 3 has the bonding layers 31, 33 and 36, the lacquer layers 34 and 35 as well as the diffractive structure 38 with the metallic coating 39 as shown in FIG. 2. In addition, an antenna 42, an adhesive layer 41 and an electronic circuit 43 are introduced between the lacquer layers 34 and 35. The antenna 42 comprises for example a partial metallic coating which is joined to the electronic circuit 43 by means of an anisotropic, conductive adhesive 41. The carrier film 32 stabilizes the electronic circuit 43 and protects it from environmental influences and attempts at manipulation. As shown in FIG. 3*b*, in the region of the electronic circuit 43, upon application of the laminating film 3, an additional depression is shaped into the paper carrier 2 so that this provides a planar surface for the value-bearing document 1 in the region of the electronic circuit 43.

Figure 4A:
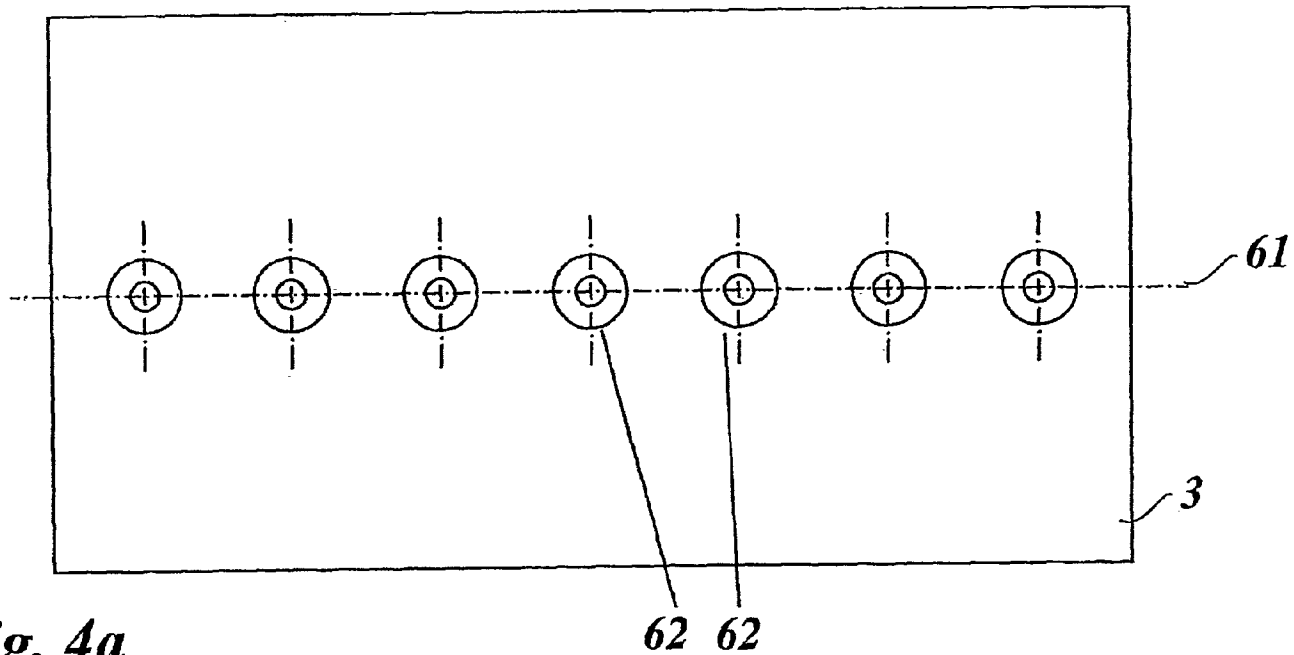
FIG. 4*c* shows a detail view of the illustration in FIG. 4*b*, FIGS. 5*a* and 5*b* show sectional views of a laminating film or a value-bearing document for a further embodiment of the invention.
Figure 4B:
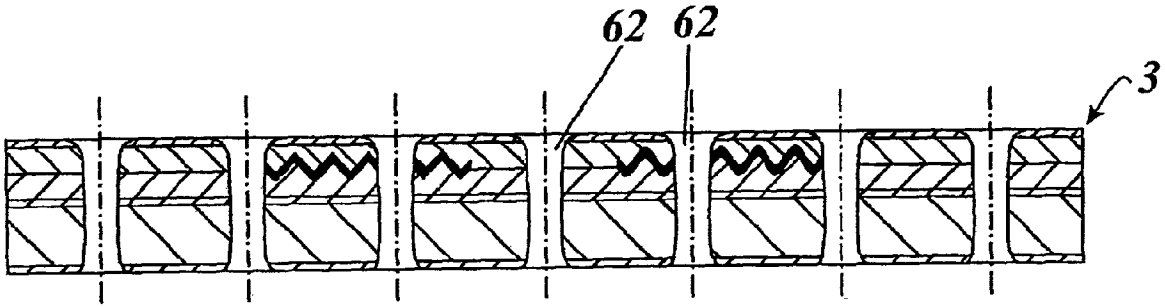

As shown in FIG. 1 the predetermined breaking locations are arranged on parallel lines 61 in the film direction. As further shown in FIGS. 4*a* and 4*b* predetermined breaking locations 62 of circular cross-section are introduced into the film 3 along the line 61, and they completely sever both the carrier 32 and also the decorative layer 30 of the laminating film 3. The strength of the laminating film is set by the design in respect of the cross-section involved, the dimensions, the profile and the arrangement, that is to say the spacing of the predetermined breaking locations 62 from each other. In that respect the strength of the laminating film is preferably so set that, both during the high thermal loading involved in the application procedure and also under the usual environmental influences, the coefficient of expansion and the thermal expansion of the laminating film are not less than the coefficient of expansion and the thermal expansion respectively of the paper carrier, and to the strength of the film is so adjusted that it cannot be detached (that is to say the adhesion between the laminating film and the paper carrier is greater than the tearing strength of the laminating film) and nonetheless the film still has sufficient stability to be processed. The configuration and arrangement of the predetermined breaking locations 62 is thus determined both by the film properties of the laminating film 3, the substrate properties of the carrier 2 and also the properties of the application procedure by means of which the laminating film 3 is applied to the carrier 2. In that respect, factors of particular significance are the kind of material of the carrier film, the thermal capacity of the carrier film 3, the thermal conductivity of the carrier film, the coefficient of expansion of the carrier film, the thickness of the carrier film, the layer sequence and layer composition of the decorative layer arrangement, and the thermal capacity, the thermal conductivity and the coefficient of expansion of the decorative layer arrangement. The kind of material, thermal capacity, thermal conductivity, coefficient of expansion, thickness and surface roughness of the carrier 2 are further of particular significance. In addition the kind of application and the process parameters of pressure, temperature and contact time are further of particular significance. The thermal capacity, thermal conductivity and thickness of the layers of the laminating film 3 and the carrier 2 as well as the pressure, temperature and contact time involved in the application procedure determine the thermal differences occurring in the application procedure between the layers of the laminating film and the substrate, which in turn determine the thermal expansion based on the respective thermal coefficient of expansion of the laminating film 3 and the carrier 2. Thus the optimum predetermined breaking location design for the respective situation of use is preferably ascertained in tests on the basis of those complex relationships.

Figure 4C:
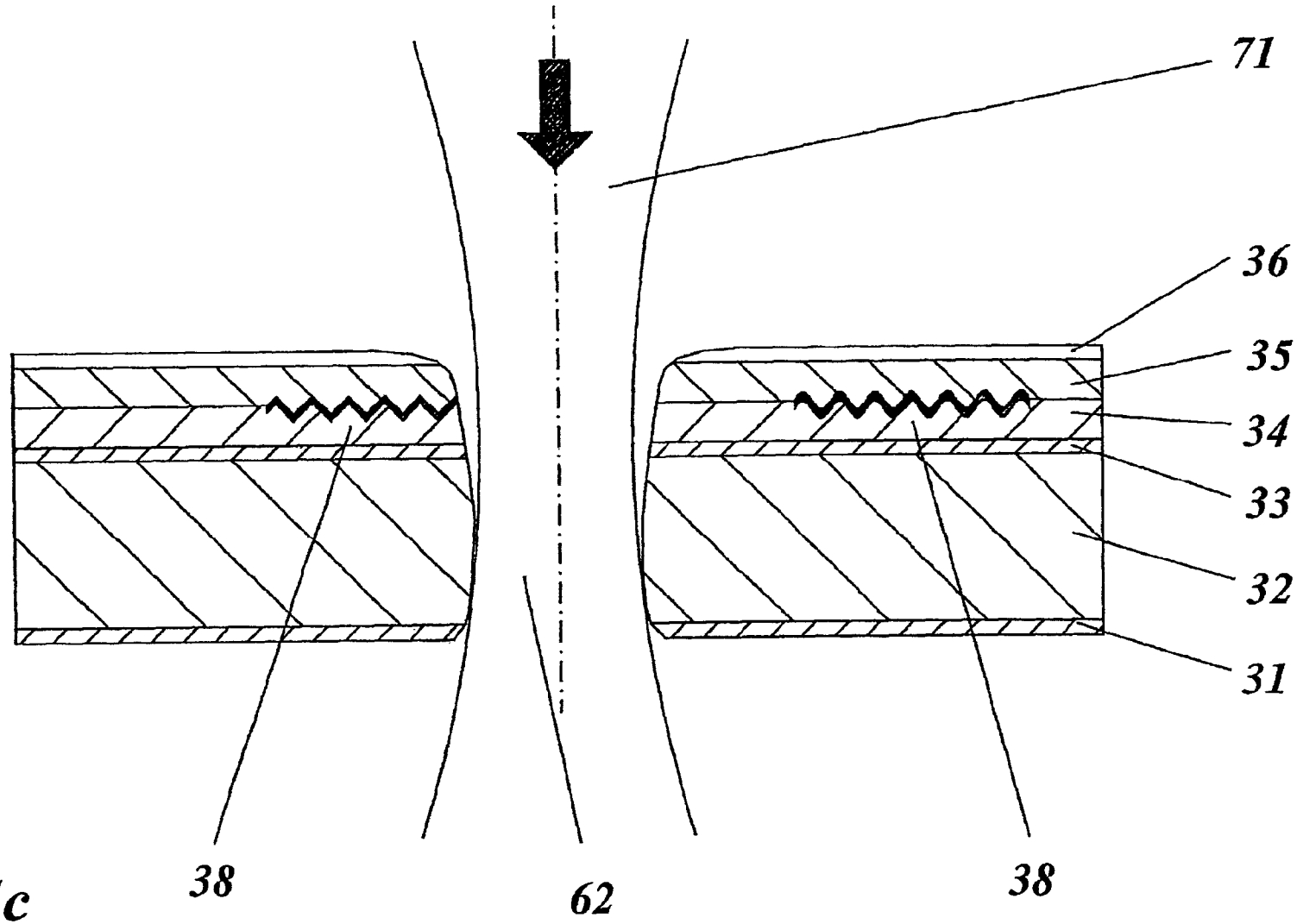

To produce the predetermined breaking locations 62, as shown in FIG. 4*c*, a laser beam acts from the side of the decorative layer arrangement 30 on the layers 33 through 36 of the decorative layer arrangement and on the carrier film 32 in such a way that those layers are removed by melting, vaporization or disintegration in the region of the laser beam. In that respect, for material removal in that fashion, it is necessary for the carrier film 32 and at least a part of the layers of the decorative layer arrangement 30 to absorb the laser radiation. That involves the absorption of energy which leads to an increase in the temperature of the material and removal of material.

The following laser beam sources can be used in this case for removal of the layers 31 through 36:

| Laser | Wavelengths | Operating mode |
|---|---|---|
| $CO_2$-laser | 10.6 μm | cw, pulse |
| Nd:YAG-laser | 1.064 μm, 532 nm, 355 nm | cw, pulse |
| Diode laser | between 650 and 950 nm | cw, pulse |
| Excimer laser | 157 nm, 193 nm, 248 nm, 308 nm, 351 nm | pulse |

If the carrier film 32 comprises a polyester carrier then excimer lasers with a wavelength of less than or equal to 308 nm as well as $CO_2$-lasers are suitable by virtue of the spectral transmission characteristics of polyester. The radiation of Nd:YAG- and diode lasers is transmitted through the polyester and can at best interact with the layer array of the decorative layer arrangement and remove that layer array.

In addition it is also possible to achieve absorption in the region of the wavelength of Nd:YAG- or diode lasers by the addition of absorbers (for example $TiO_2$) or by a variation in the binding agent system. In that respect it is appropriate if the absorbent layer or the layer which is made absorbent in the decorative layer arrangement is disposed as closely as possible to the carrier film. The absorbed laser radiation increases the temperature of that layer, wherein layers disposed thereabove can also be correspondingly removed by liquefaction, gas formation and vaporization.

Figure 5A:
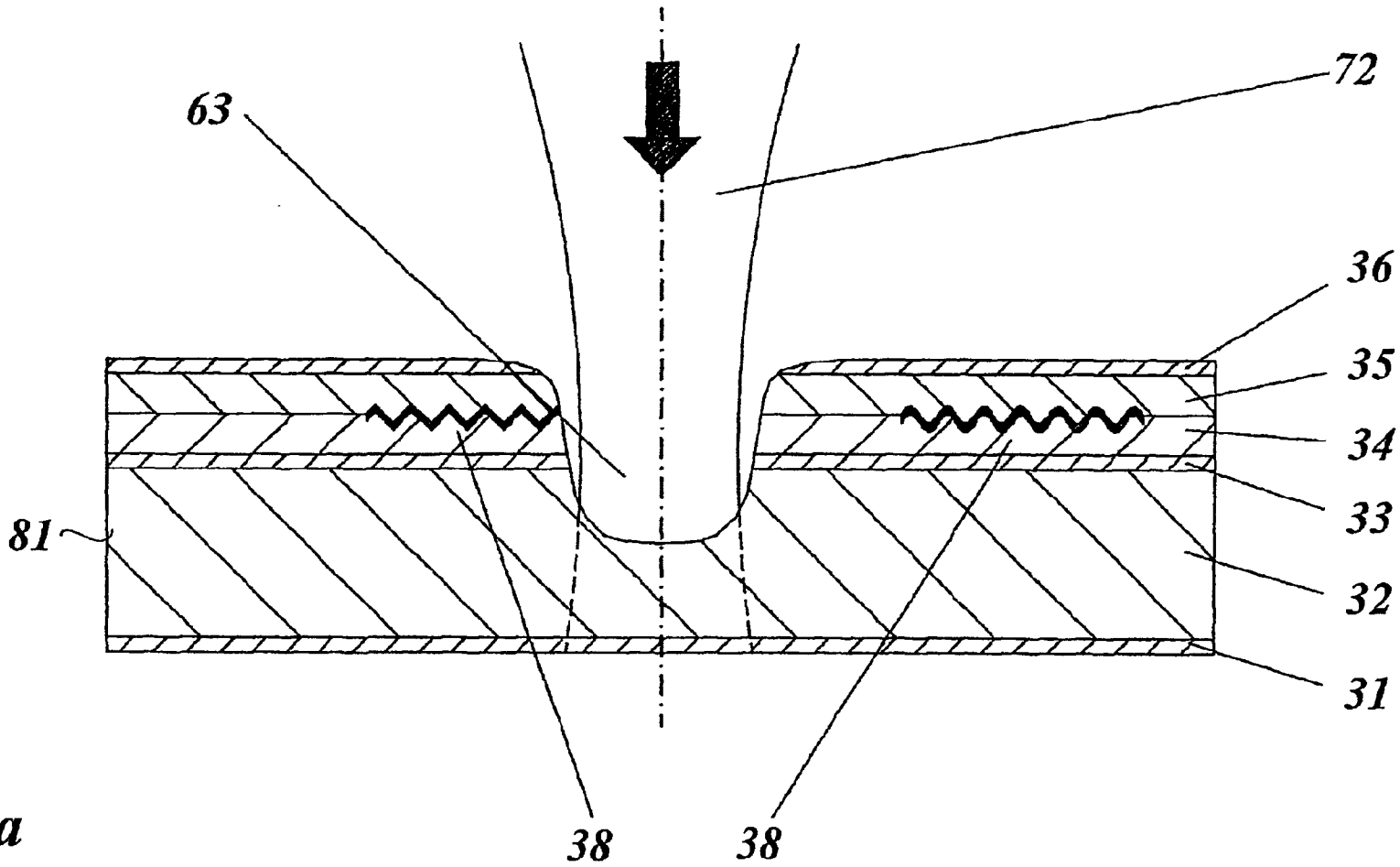
Figure 5B:
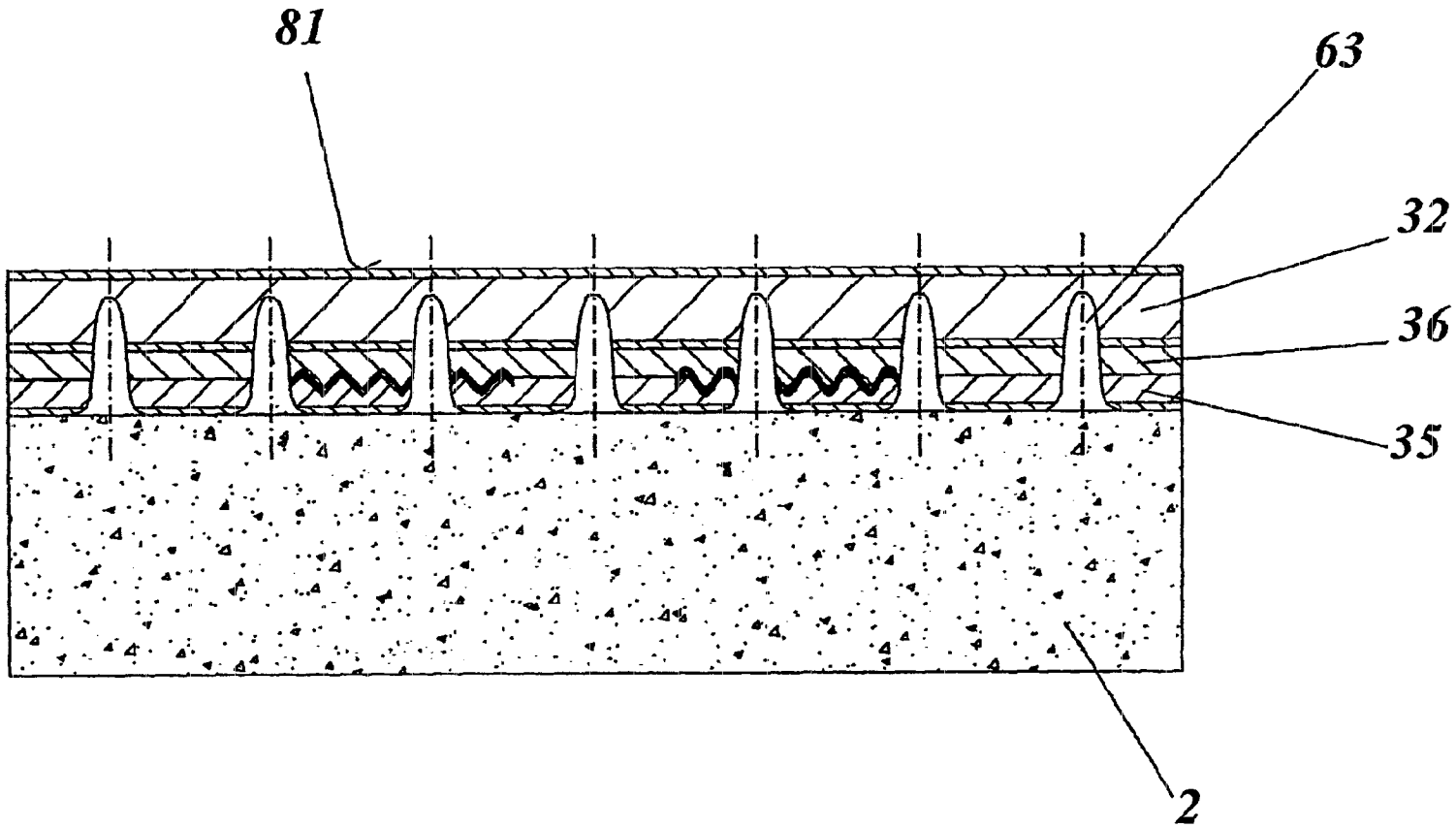

It is of particular advantage in that respect if the parameters of the laser beam, that is to say intensity and irradiation duration, are so adjusted that the result produced is not a though hole as shown in FIG. 4*c* but a blind hole in the laminating film 3 as shown in FIGS. 5*a* and 5*b*. Thus FIG. 5*a* shows a laminating film 81 which, like the laminating film 3 shown in FIG. 2, is made up from the bonding layer 31, the carrier film 32, the bonding layer 33, the lacquer layers 34 and 35 with diffractive structure 38 shaped therein and the bonding layer 36. The intensity of a laser beam 72 is now so selected that the predetermined breaking location 63 produced is a blind hole which is formed in the laminating film 81 and which does not completely sever the carrier film 32. After application of the laminating film 81 to the carrier of the value-bearing document the predetermined breaking locations 63 are admittedly present in the laminating film 81 but they are not visible at the surface, as is shown in FIG. 5*b*. The strength which is reduced by virtue of the blind hole affords on the one hand the above-discussed advantages, wherein the depth of the blind hole affords still a further variable for adjusting the mechanical properties of the laminating film. On the other hand, the fact that the laminating film 81 is provided with predetermined breaking locations remains concealed to the person viewing it so that the predetermined breaking locations 63 also cannot influence the design of the security feature of the laminating film 81.

Figure 6:
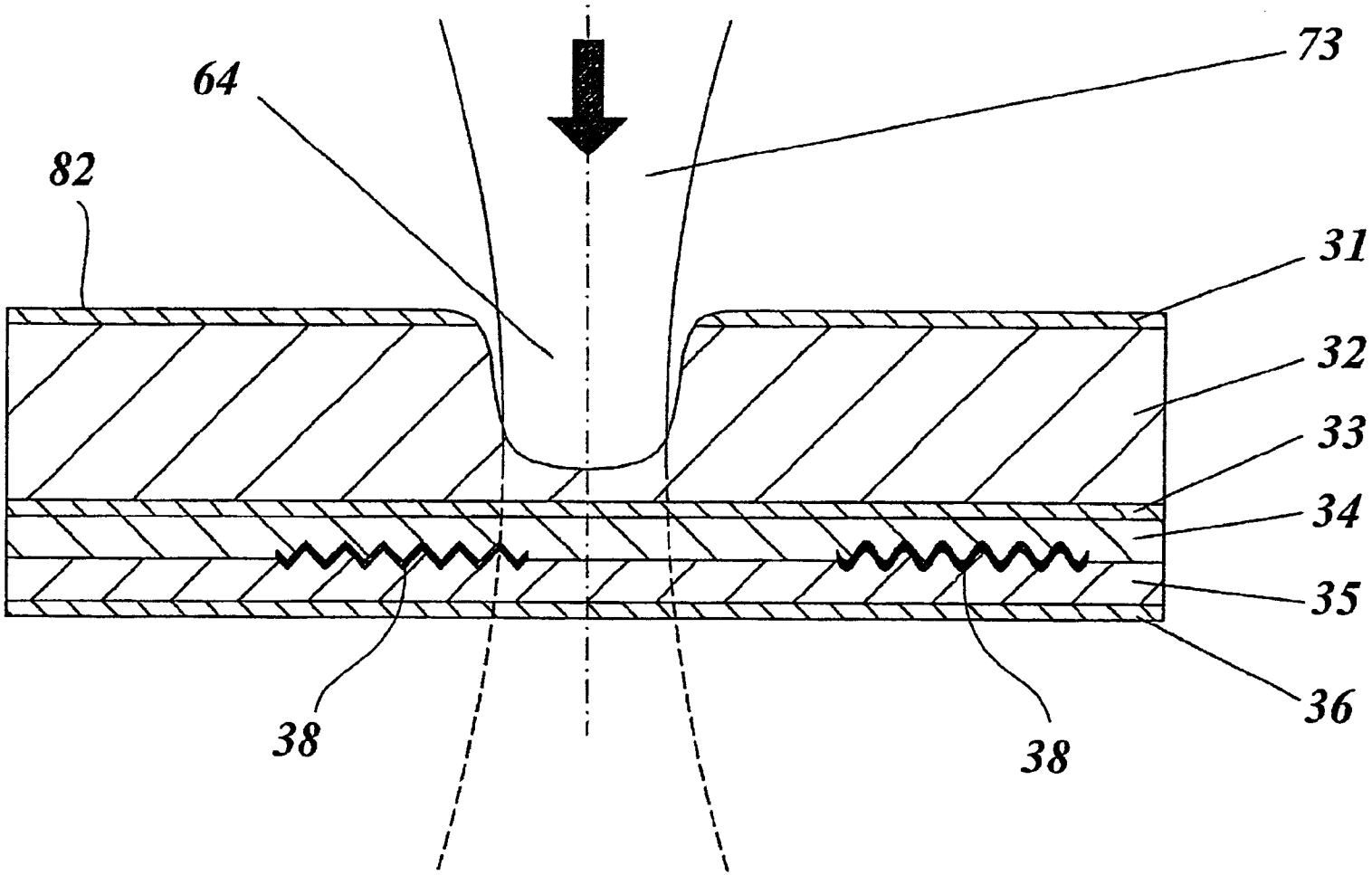
FIG. 6 shows a sectional view of a laminating film for a further embodiment of the invention.

A further possible way of producing predetermined breaking locations involves irradiating a laminating film with a laser, from the side of the carrier film. FIG. 6 shows a laminating film 82 which is processed in that way and which is made up of the bonding layer 31, the carrier film 32, the bonding layer 33, the lacquer layers 34 and 35 with the shaped diffractive structure 38 and the bonding layer 36 shown in FIG. 2. The laminating film 82 is irradiated with a laser 73 whose intensity and irradiation duration are so adjusted that a blind hole is generated in the carrier film 32 as the predetermined breaking location 64, the blind hole partially but not completely severing the carrier film 32. This option presents itself if the predetermined breaking locations are to be produced in the laminating film immediately prior to application of the laminating film in the application machine or after application has been effected on the carrier. In the latter case in fact irradiation is only possible from the carrier film side but in contrast not from the generally non-transparent side of the carrier of the value-bearing document.

By virtue of the fact that the laminating film 82 is not completely severed by means of the laser beam 73, this also provides here that the predetermined breaking location 64 remains optically substantially concealed from the viewer and thus scarcely influences the design of the security feature. Furthermore in this case also protection of the layers of the decorative layer arrangement by the carrier film is retained as the latter is in fact not completely severed. Preferably in that case the diameter of the predetermined breaking locations 64 is selected to be as small as possible and preferably below the resolution capability of the human eye, whereby the optical appearance and also the protection from weathering influences are optimized.

Figure 7A:
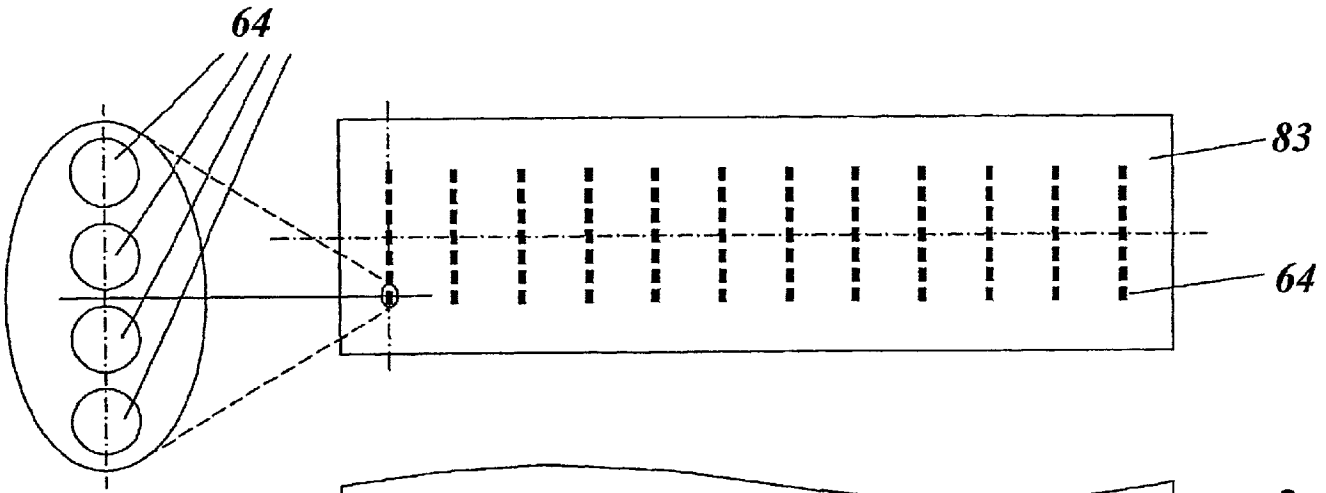
FIGS. 7*a* and 7*b* show diagrammatic views of a laminating film prior to and after application to the carrier of a value-bearing document.
Figure 7B:
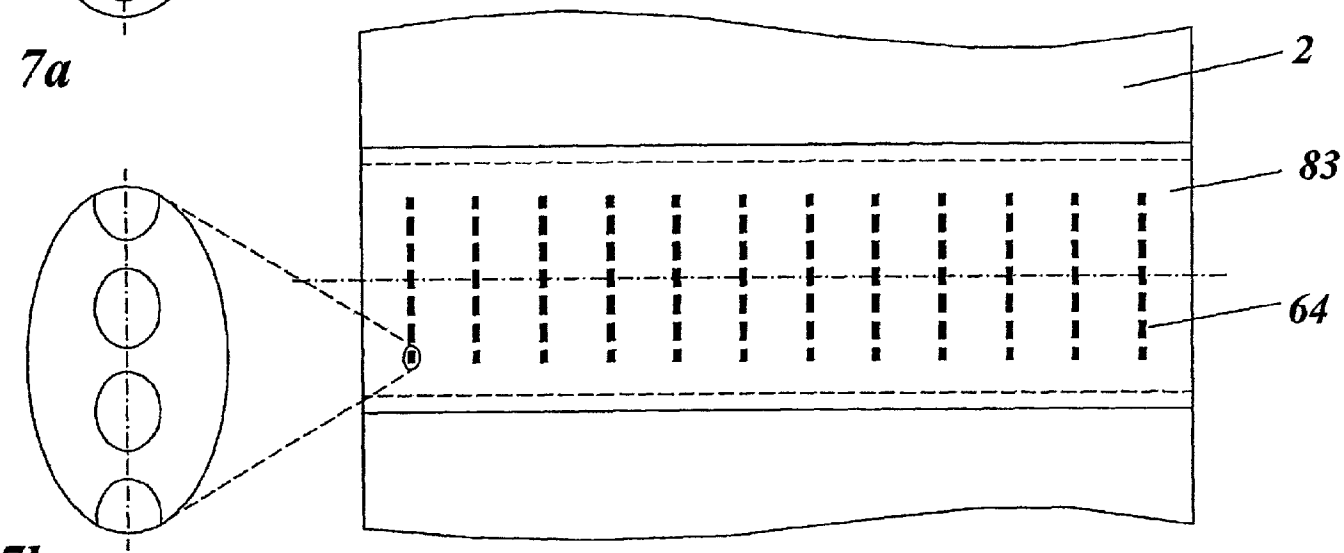

FIGS. 7*a* and 7*b* show a laminating film 83 according to the invention prior to and after application to the carrier 2 of a value-bearing document. Predetermined breaking locations 64 which are of a round cross-section are formed in the laminating film 63 on lines in the expansion direction. The stresses upon cooling after application can be reduced by virtue of the predetermined breaking locations produced. As shown in FIG. 7*b* the cross-sections of the predetermined breaking locations 64 have been deformed in an oval configuration after cooling, that is to say the predetermined breaking locations 64 permitted corresponding expansion of the laminating film 83 and thus prevented distortion of the value-bearing document in the region thereof which surrounds the laminating film 83.

It is also possible to produce predetermined breaking locations of rectangular, square or other cross-sections, instead of predetermined breaking locations of circular cross-section, by the use of suitable beam-shaping optical systems.

Under some circumstances it is also advantageous for predetermined breaking locations to be arranged to extend on lines in transverse relationship with the expansion direction. That is shown in FIGS. 8*a* and 8*b*.

Figure 8A:
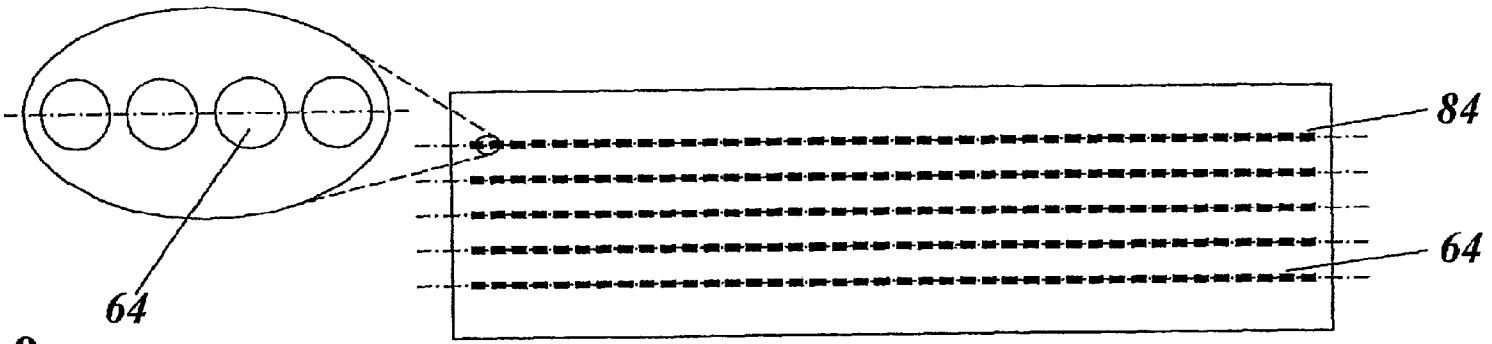
FIGS. 8*a* and 8*b* show diagrammatic views of a laminating film prior to and after application to the carrier of a value-bearing document for a further embodiment of the invention.
Figure 8B:
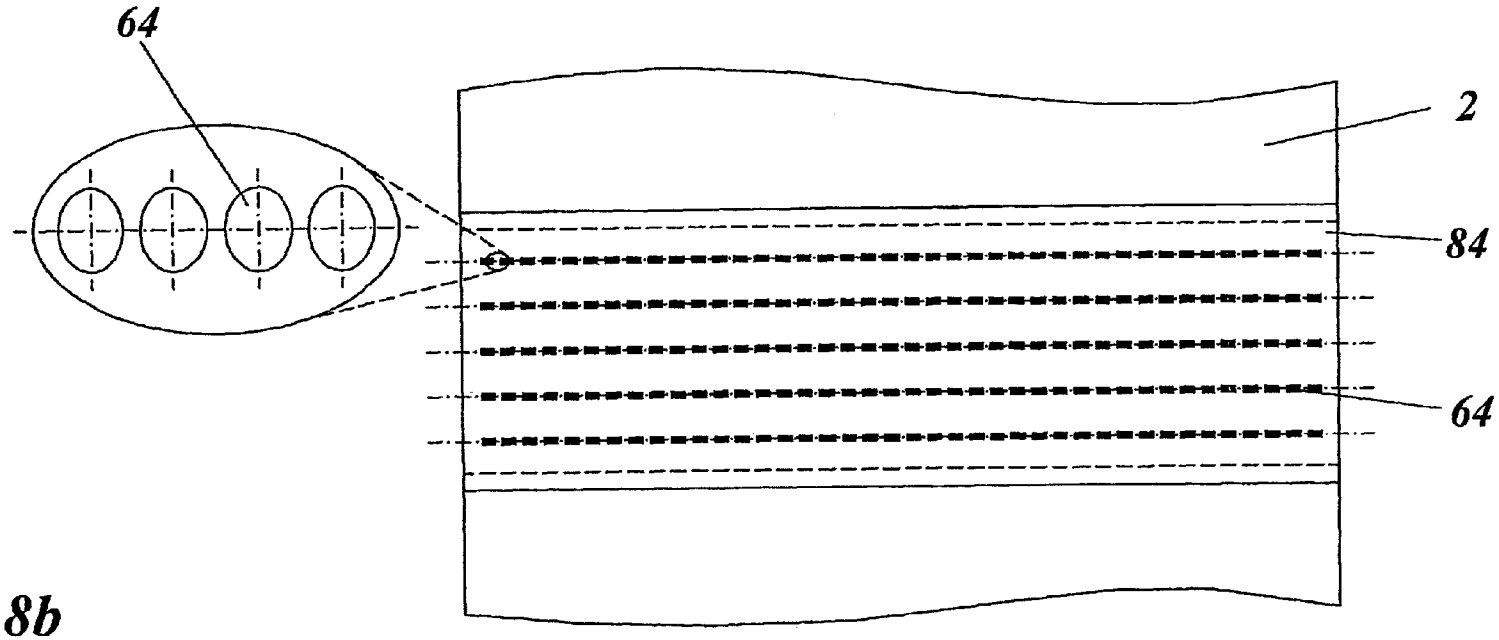

FIGS. 8*a* and 8*b* show a laminating film 84 prior to and after application to the carrier 2 of a value-bearing document. Predetermined breaking locations 64 are disposed on parallel lines which extend transversely to the expansion direction. As shown in FIG. 8*b* the predetermined breaking locations are deformed to an oval configuration after cooling, thereby permitting corresponding expansion of the laminating film 84 upon application.

Figure 9A:
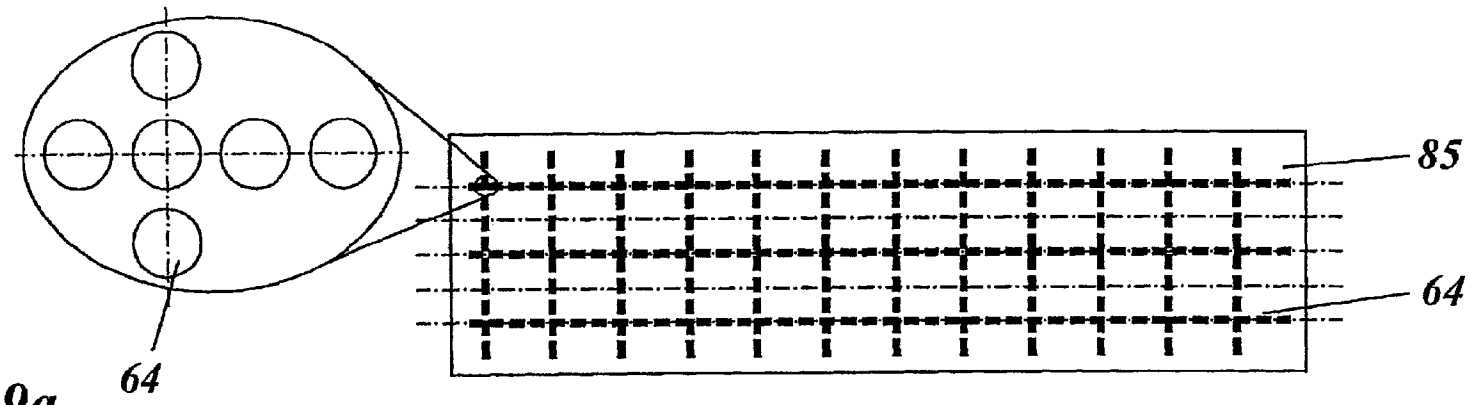
FIGS. 9*a* and 9*b* show diagrammatic views of a laminating film prior to and after application to the carrier of a value-bearing document for a further embodiment of the invention.
Figure 9B:
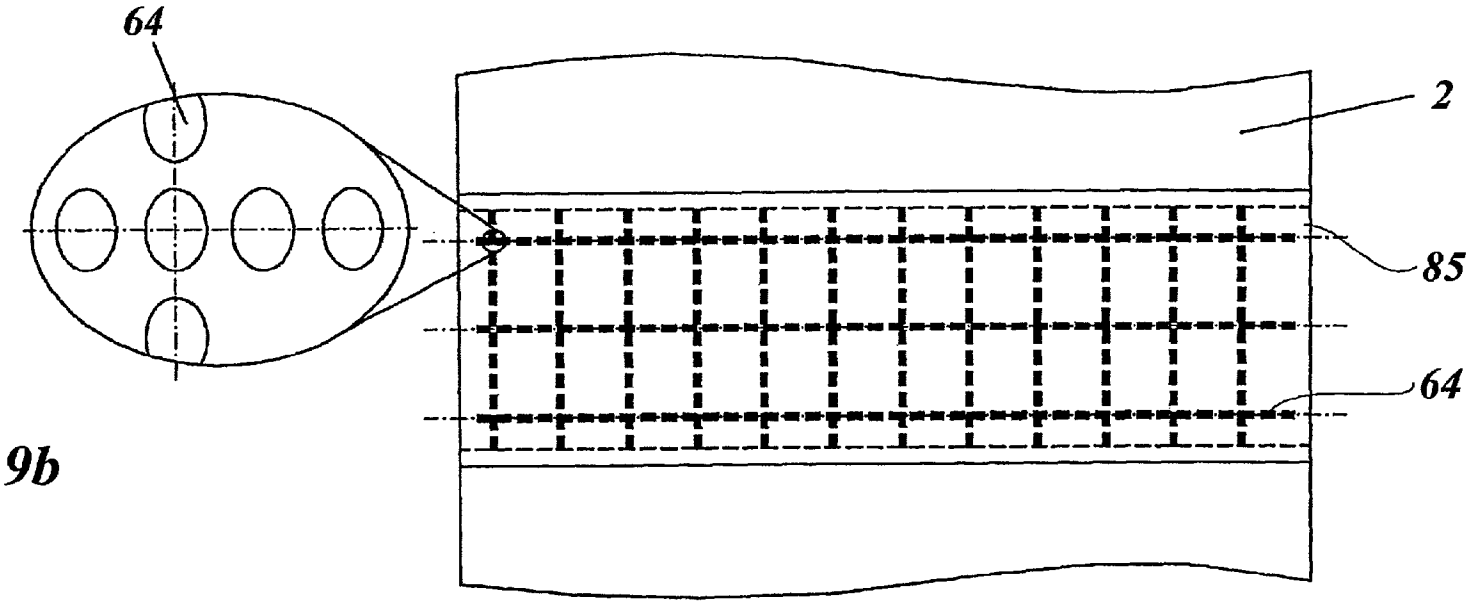
Figure 10A:
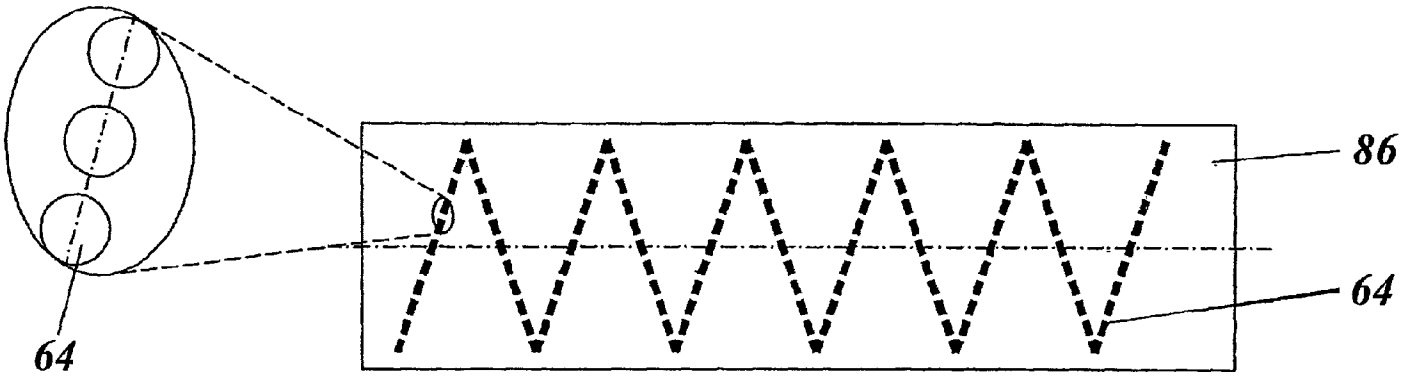
FIGS. 10*a* and 10*b* show diagrammatic views of a laminating film prior to and after application to the carrier of a value-bearing document for a further embodiment of the invention.
Figure 10B:
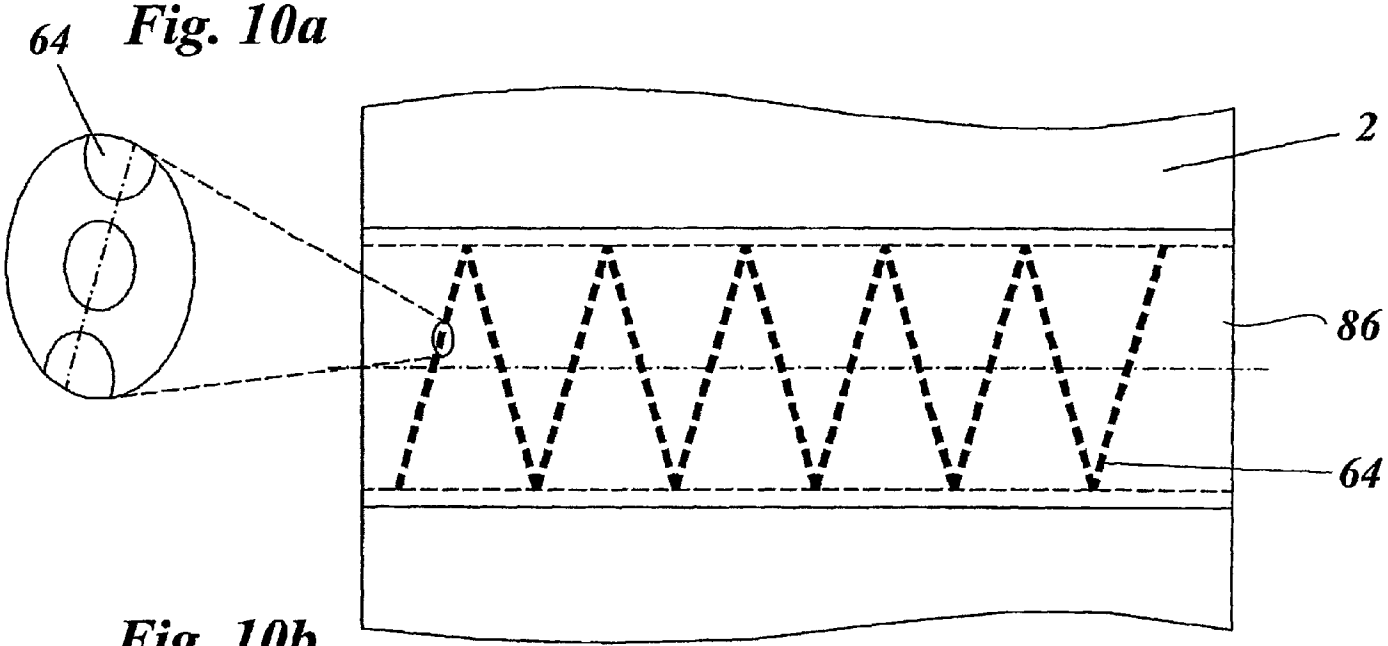

In addition it is also possible for the predetermined breaking locations to be arranged both on lines in the expansion direction and also on lines transversely with respect thereto, as is shown in respect of a laminating film 85 in FIGS. 9*a* and 9*b*, or it is possible for predetermined breaking locations to be arranged for example in a zig-zag pattern as is shown in respect of a laminating film 86 by FIGS. 10*a* and 10*b*.

It is also possible for the predetermined breaking locations to be provided in any arrangement.

Figure 11:
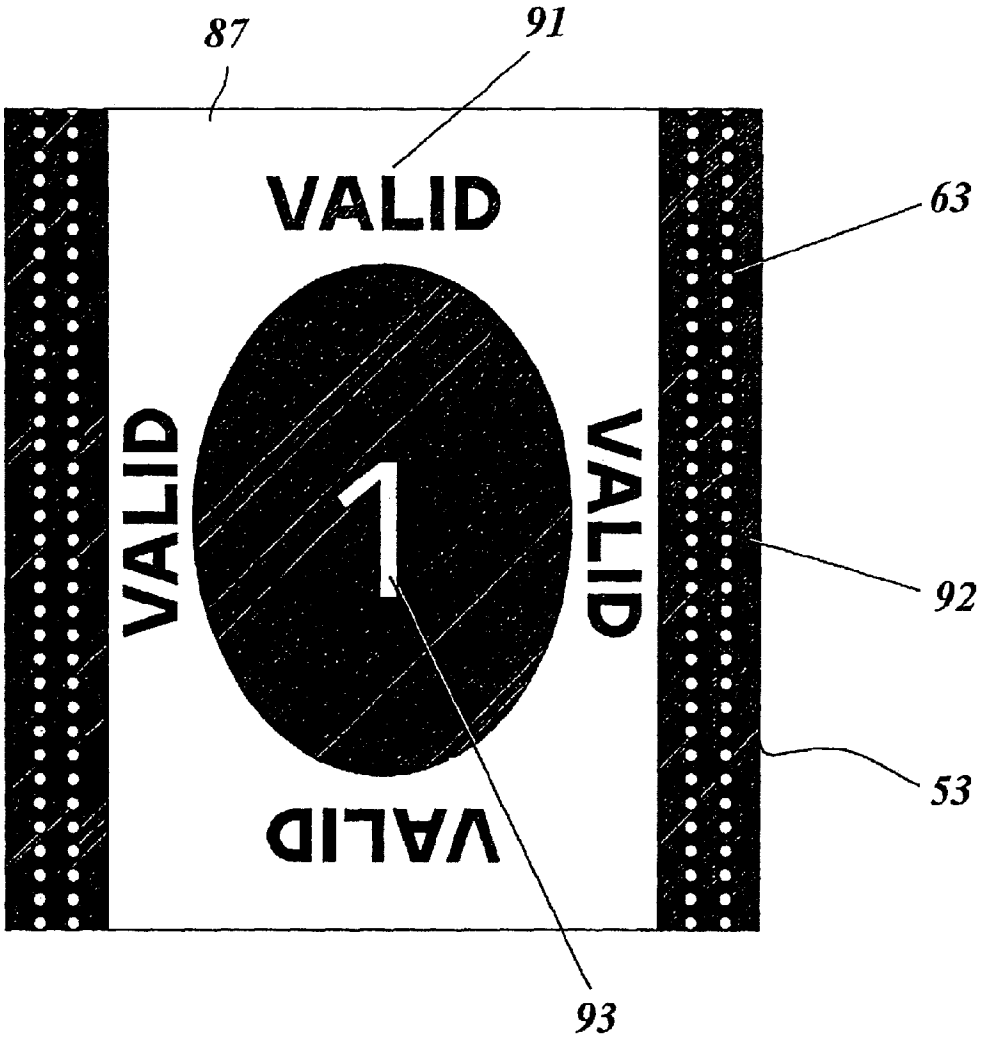
FIG. 11 shows a plan view of a laminating film for application to a value-bearing document for a further embodiment of the invention.

Furthermore there is also the possibility of predetermined breaking locations being integrated into the design of security features in the laminating film. Thus FIG. 11 shows a security feature 53 of a laminating film 87, the security feature being formed by partial metallization. Demetallized regions of the security element 53 are produced by a procedure whereby a metallic coating which is applied over the full surface area is removed region-wise by means of conventional processes, for example positive and negative etching or laser ablation. Thus in the central region the security feature 53 has a demetallization in the form of a "1" while in the region surrounding the central region it has a metallization in the form of positive script "VALID". Now predetermined breaking locations 63 are produced in the laminating film 87 in the region of the security feature 53 by suitable control of the laser beam, for example on the basis of register marks on the laminating film 87. In that situation the predetermined breaking locations are produced in accurate register relationship in the metallized edge strip of the security feature 53 and thus integrated into the demetallization design of the security feature 53. In that case, because of the very small diameter of the laser beam, it is possible to attain a quality of demetallization which is not possible with conventional processes, whereby the predetermined breaking locations can serve as an additional security feature.

What is claimed is:

1. A value-bearing document comprising:

a carrier comprising a paper material and a laminating film which is applied to the carrier, wherein the laminating film has a carrier film and a decorative layer including one or more security features and/or one or more components with electrical functionalities, and wherein the laminating film is provided with predetermined breaking locations for reducing the strength of the laminating film, wherein the arrangement and dimensioning of the predetermined breaking locations is selected such that mechanical characteristics of the laminating film are adapted to mechanical characteristics of the paper carrier, whereby thermal expansion of the laminating film is approximately equal to thermal expansion of the paper carrier.

2. A value-bearing document as set forth in claim 1, wherein the strength of the laminating film is reduced in the region of the predetermined breaking locations by perforation or partial severing of one or more layers of the laminating film.

3. A value-bearing document as set forth in claim 2, wherein in the region of the predetermined breaking locations one or more layers of the laminating film are at least partially removed by means of a laser beam.

4. A value-bearing document as set forth in claim 3, wherein one or more layers of the laminating film are provided with micro-perforations by means of laser beam in the region of the predetermined breaking locations.

5. A value-bearing document as set forth in claim 2, wherein in the region of the predetermined breaking locations one or more layers of the laminating film are processed by means of mechanical processes thereby reducing the strength of the laminating film.

6. A value-bearing document as set forth in claim 1, wherein the strength of the laminating film is reduced in the region of the predetermined breaking locations by a partial change in the physical properties of one or more layers of the laminating film.

7. A value-bearing document as set forth in claim 1, wherein the carrier film is severed in the region of the predetermined breaking locations.

8. A value-bearing document as set forth in claim 1, wherein in the region of the predetermined breaking locations the carrier film is provided with blind holes which do not completely sever the carrier film.

9. A value-bearing document as set forth in claim 8 wherein the blind holes are arranged on the side of the carrier film, that is towards the carrier.

10. A value-bearing document as set forth in claim 1, wherein the laminating film having at least one layer of a strength that is constant throughout and at least another layer reduced in strength at least in the region of the predetermined breaking locations.

11. A value-bearing document as set forth in claim 1, wherein the side of the laminating film, that is towards the carrier, is provided in the region of the predetermined breaking locations with perforations for hooking of the paper fibers.

12. A value-bearing document as set forth in claim 1, wherein the predetermined breaking locations are arranged on lines in an expansion direction.

13. A value-bearing document as set forth in claim 12, wherein the predetermined breaking locations are further arranged in lines transversely to the expansion direction.

14. A value-bearing document as set forth in claim 1, wherein the predetermined breaking locations are arranged on lines transversely to an expansion direction.

15. A value-bearing document as set forth in claim 1, wherein the laminating film is in the form of a strip and that the predetermined breaking locations are arranged on one or more lines in the longitudinal direction of the strip.

16. A value-bearing document as set forth in claim 15, wherein the one or more lines extend substantially across the carrier.

17. A value-bearing document as set forth in claim 1, wherein the predetermined breaking locations are oriented in accurate register relationship with patterns of a security element of the laminating film.

18. A value-bearing document film as set forth in claim 1, wherein the decorative layer arrangement has two or more different security elements.

19. A value-bearing document as set forth in claim 1, wherein the carrier has one or more window-shaped openings which are closed by means of the laminating film which projects beyond the openings on all sides.

20. A value-bearing document as set forth in claim 19, wherein the predetermined breaking locations are arranged to at least partly extend across the one or more window-shaped openings.

21. A value-bearing document as set forth in claim 1, wherein the predetermined breaking locations are arranged on lines oblique to lines in an expansion direction.

22. A value-bearing document as set forth in claim 1, wherein the predetermined breaking locations are arranged on lines extending in a zig-zag pattern.

23. A value-bearing document as set forth in claim 1, wherein the predetermined breaking locations are concealed to a person viewing the value-bearing document.

24. A value-bearing document as set forth in claim 1, wherein the thermal expansion of the laminating film is not less than thermal expansion of the paper carrier.

25. A value-bearing document as set forth in claim 1, wherein an adhesion between the film and the paper carrier is greater than a tearing strength of the film.

26. A process for the production of a value-bearing document wherein in the process a laminating film is applied to a carrier, comprising paper material, of the value-bearing document, which laminating film has a carrier film and a decorative layer including one or more security features and/or one or more components with electrical functionalities, comprising:

the laminating film is provided with predetermined breaking locations for reducing the strength of the laminating film, wherein the arrangement and dimensioning of the predetermined breaking locations is selected such that mechanical characteristics of the laminating film are adapted to mechanical characteristics of the paper carrier, whereby thermal expansion of the laminating film is approximately equal to thermal expansion of the paper carrier.

27. A process as set forth in claim 26, wherein the predetermined breaking locations are introduced into the laminating film prior to application of the laminating film to the carrier.

28. A process as set forth in claim 27, wherein prior to application of the laminating film to the carrier the laminating film is provided with blind holes from the side that is towards the carrier in the region of predetermined breaking locations.

29. A process as set forth in claim 26, wherein the predetermined breaking locations are introduced into the laminating film after application of the laminating film to the value-bearing document.

30. A value-bearing document as set forth in claim 26, wherein subsequent to application of the laminating film to the carrier the predetermined breaking locations being concealed to a person viewing the value-bearing document.

31. A value-bearing document as set forth in claim 26, wherein the thermal expansion of the laminating film is not less than thermal expansion of the paper carrier.

32. A value-bearing document as set forth in claim 26, wherein an adhesion between the film and the paper carrier is greater than a tearing strength of the film.

* * * * *